US005512424A

United States Patent [19]

Yoshimoto

[11] Patent Number: 5,512,424

[45] Date of Patent: Apr. 30, 1996

[54] METHOD FOR MANUFACTURING TABLET PROCESSING AGENT FOR SILVER HALIDE PHOTOGRAPHIC LIGHT-SENSITIVE MATERIALS

[75] Inventor: Hiroshi Yoshimoto, Hino, Japan

[73] Assignee: Konica Corporation, Tokyo, Japan

[21] Appl. No.: 402,384

[22] Filed: Mar. 13, 1995

[30] Foreign Application Priority Data

Mar. 18, 1994 [JP] Japan ..... 6-049009

[51] Int. Cl.[6] ..... G03C 5/30; G03C 5/38; G03C 5/42

[52] U.S. Cl. ..... 430/458; 430/449; 430/461; 430/465

[58] Field of Search ..... 430/458, 460, 430/465, 461, 449

[56] References Cited

U.S. PATENT DOCUMENTS

| | | | |
|---|---|---|---|
| 5,202,067 | 4/1993 | Solazzi et al. | 264/40.5 |
| 5,366,853 | 11/1994 | Toshimoto | 430/458 |
| 5,409,805 | 4/1995 | Haraguchi et al. | 430/458 |

FOREIGN PATENT DOCUMENTS

| | | | |
|---|---|---|---|
| 0547796A1 | 6/1993 | European Pat. Off. . | |
| 0624821 | 11/1994 | European Pat. Off. | 430/465 |

OTHER PUBLICATIONS

Gerhartz et al. "Ullmann's Encyclopaedia of Industrial Chemistry", vol. B2, pp. 7–35, 1988.

Armstrong. "Causes of Tablet Compression Problems", 870 Manufacturing Chemist and Aerosol News, vol. 53, Oct. 1982.

Hagers, "Handbuch Der Pharmazeutiscen Praxis, Band VII, Teil A" 1971, Springer–Verlag, Berlin, pp. 713–716.

Remington's Pharmaceutical Sciences Ed. 17, Mack Publishing Co., 1985, p. 1620.

Sucker, et al. "Pharmazeutische Technologie" 1991 Georg Thieme Verlag, pp. 294, 301.

*Primary Examiner*—Richard L. Schilling

*Attorney, Agent, or Firm*—Finnegan, Henderson, Farabow, Garrett & Dunner

[57] ABSTRACT

A method of manufacturing a tablet processing agent for a silver halide photographic light-sensitive material is disclosed, which comprises the step of molding particles into tablets at a compression pressure of 400 to 4500 kg/cm$^2$ and at a compression dwell time of 0.015 to 1.000 second to obtain the tablet processing agent, wherein the particles comprises a compound selected from the group consisting of a p-phenylene diamine and its derivatives, a hydroxylamine and its derivatives, an alkali metal carbonate, an amino polycarboxylic acid ferric complex and a thiosulfate.

8 Claims, 2 Drawing Sheets

METHOD FOR MANUFACTURING TABLET PROCESSING AGENT FOR SILVER HALIDE PHOTOGRAPHIC LIGHT-SENSITIVE MATERIALS

FIELD OF THE INVENTION

The invention relates to a method for manufacturing a tablet processing agent for a silver halide photographic light-sensitive material.

BACKGROUND OF THE INVENTION

A silver halide photographic light-sensitive material is photographically processed through a development step, a bleaching step, a washing step and a stabilization step after being exposed. The photographic processing is ordinarily conducted using an automatic processing machine. On such occasions, a replenisher replenishing system is commonly used wherein the processing solution in a processing tank is controlled so that the activity thereof is kept constant. In the case of the replenisher replenishing system, the purposes thereof include dilution of materials dissolved out from the light-sensitive material, correction of the amount of evaporation and replenishment of consumed components. Because of solution replenishing, much overflow-solution is ordinarily discharged.

Incidentally, world wide movements for regulations on prohibiting dumping photo-effluent into oceans and regulations against disposal of plastic materials have been promoted. Accordingly, development of a new system in which photographic waste solution is markedly reduced and bottles for processing agents are eliminated is demanded. In addition, safety regulations on packaging materials have been made strengthened to maintain safety regarding the transportation of liquid hazardous substances, resulting in an increase of cost. In mini-labs which have recently proliferated rapidly, errors frequently occur during dissolution or dilution operations of the replenishing solutions due to a lack of man power. Therefore, this conventional replenishment system has drawn much frequent complaints.

Accordingly, in the photographic industry a new replenishing system is demanded in which photographic waste solution is markedly reduced, bottles for processing agents are eliminated and dissolving operations are also eliminated.

In response to these demands Japanese Patent O.P.I Publication No. 5-119454/1993 discloses a method of tableting almost all processing components and directly supplying tablets into processing tanks. Tablet processing agents are packaged after the manufacture, and stored at a warehouse. Thereafter, the agents are transported by various means and used at mini-labs, however, there are a problem of tablet expansion when the period from the manufacture until usage is long.

The following problems have been found regarding tablets. The increase of diameter and thickness of a tablet makes it impossible to insert the tablet into the supplying device of the solid processing agent or the tablet is broken to powder in the inserting. The tablets expand during a long term storage in a warehouse. The expanded tablets are broken to powder by vibration or friction among tablets during transport. It has been found that when packages containing the tablets are unpacked, the powder occurs and there is a problem in operation that loose powder scatters.

The tablets are incorporated into the processing solution of a processing tank. For example, in a color developing tablet, tarred powder and/or tablets adhere to a light sensitive material to be processed and cause trouble. In a bleach-fixing or fixing tablet, sulfurized powder and/or tablets adhere to the processing tank and damage the light sensitive material to be processed. There is a serious problem particularly in a film for photographing. Thus, it has been found that there are problems caused by the expansion of tablets during storage.

The development of a manufacturing method of a tablet processing agent has been demanded which solves the above problems, eliminates bottles of processing agents and is free from the dilution operation.

SUMMARY OF THE INVENTION

Accordingly, a first object of the invention is to remove liquid chemicals which are dangerous to transport or handle and to further provide a replenishing system of solid chemicals without complex operations for customers. A second object of the invention is to provide a manufacturing method of a tablet processing agent free from shape changes and fine powder occurrence or defects or breakage of the tablet due to the change.

DETAILED DESCRIPTION OF THE INVENTION

Figure 1:
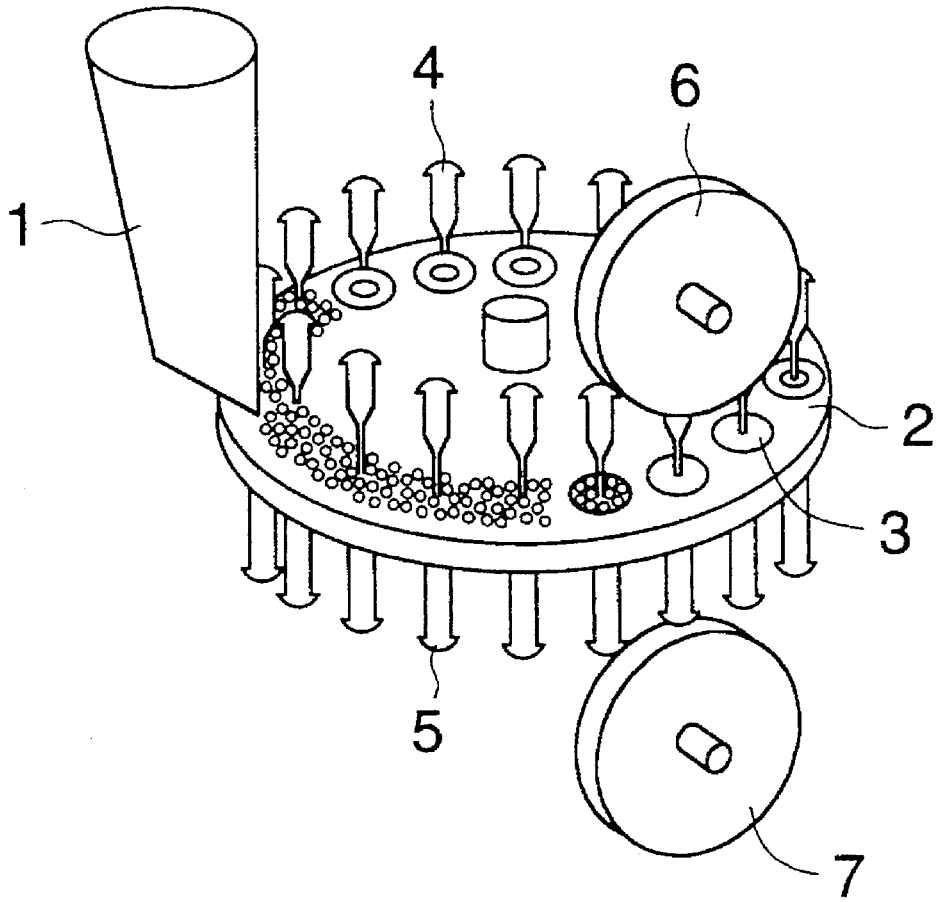
FIG. 1 is a perspective view showing an outline of the example of the rotary tablet machine.

The inventor has found that the above mentioned problems can be overcome by a method of manufacturing a tablet processing agent for a silver halide photographic light-sensitive material comprising molding at a compression pressure of 400 to 4500 kg/cm$^2$ and at a compression dwell time of 0.020 to 1.000 second particles and/or granules containing at least one of the following compounds (a) through (e):

(a) a p-phenylene diamine color developing agent (b) a hydroxylamine and/or its derivatives (c) an alkali metal carbonate (d) an amino polycarboxylic acid ferric complex and (e) a thiosulfate.

In this manufacturing method it is preferable that the particles and/or granules have a moisture content of 0.05 to 3.0 wt %, not more than 10 wt % of the particles and/or granules are particles and/or granules having a diameter of 53 μm or less, the particles and/or granules have a bulk density of 0.4 to 0.95 g/cm$^3$, or strength of the particles and/or granules is 100 to 400 g/$^2$.

The strength is represented by the following equation:

Strength of granules=0.7 P/A (g/mm$^2$)

$A=\pi d^2\times 1/4$,

A : a cross-sectional area (mm$^2$) of granules

P : a loading weight (g) at which the granules are broken d : a diameter of the granules (mm).

The present inventor has found that there is a difference in the expansion of tablets among tablets having the same hardness, the expansion can be controlled by a compression dwell time in manufacturing the tablets and tablets manufactured at a compression pressure of 400 to 4500 kg/cm$^2$ markedly reduce the above expansion.

Tablets produced at a compression dwell time of less than 0.020 seconds and at a compression pressure within the range described above expand during storage, since pressure strain inside the tablets is not sufficiently relaxed. This is probably because the binding ability inside the tablets is reduced by the strain. Tablets produced at a compression dwell time exceeding 1.000 second are assumed to expand during storage on account of lowering of the strength, although the strain is assumed to be relaxed. It is surprising that determining a compression dwell time and a compression pressure in molding can overcome troubles due to the tablet expansion. Further, it has been proved that this has another great effect on prevention of defects, breakage and anti-abrasion even in tablets which are not expanded to a lesser degree. It is surprising that this technique, preventing the expansion, removes the strain, enhances the binding ability and improves the strength and anti-abrasion property of the tablets.

The invention will be described in detail below.

The particles in the invention refer to particles having a particle diameter of 53 to 2830 μm, or granules having a particle diameter of 53 to 2830 μm which are obtained by granulating powder, and have preferably a weight average particle diameter of 100 to 600 μm. The weight average particle diameter in the invention refers to one obtained by a screening method. The weight average particle diameter (D) is represented by the following:

Weight average particle diameter $(D)=(\Sigma n \cdot d)/(\Sigma n)$ wherein d represents a center value of sieve meshes according to JIS Standard and n represents a weight frequency of the particles. The powder refers to an aggregate of fine particle crystals.

The compression dwell time will be explained in the manufacturing method of the present invention.

In order to manufacture tablets of solid processing agent from granular or particle solid processing agent by means of compression, it is necessary to provide a process for changing an initial space in which the granular or particle solid processing agent exists into the same configuration as that of a predetermined tablet. In this case, the method can be arbitrarily selected.

For example, a compression device can be used which is equipped with upper and lower pounder-shaped members moving upward and downward so as to compress the solid processing agent in the vertical direction. As long as a compressing action can be exerted on the solid processing agent, one of the pounder-shaped members may be fixed. From the viewpoint of enhancement of workability, it is preferable that the compressing motion is carried out in the vertical direction. However, as long as particles of solid processing agent can be compressed into a predetermined form of tablet, the direction of compression is not specifically limited. It can be arbitrarily determined.

The compression dwell time described in the present invention is defined as follows:

When the particle solid processing agent is compressed by the method arbitrarily selected as described above, the compression dwell time is from (1) a moment at which the initial space has been just formed into a predetermined configuration of tablet (referred to as a setting space hereinafter), to (2) a moment at which the setting space is returned to the initial space. When the compressing motion is further advanced passing through the moment (1), a space formed at the final end point of compression is referred to as a compression end point space. In this case, the compressing motion is returned from the compression end point space to the initial space through the setting space described above. In this case, it is possible to determine a moment at which the motion passes through the setting space to be the moment (2). It is also possible to determine a moment at which the motion has reached the setting space to be the moment (2).

A method of computing the compression dwell time will be explained below referring to a rotary tablet machine as an example.

FIG. 1 is a schematic illustration showing an overall arrangement of the rotary tablet machine. Particles and/or granules are supplied from the hopper 1 to the mortar 3 arranged on the turn table 2. When the turn table 2 rotates, particles and/or granules are pinched between the upper and the lower pounder in the mortar 3. Then, particles and/or granules are compressed and formed into tablets. Numeral 6 is an upper compression roller for pushing the upper pounder 4 downward, and numeral 7 is a lower compression roller for pushing the lower pounder 5 upward.

Figure 2A:
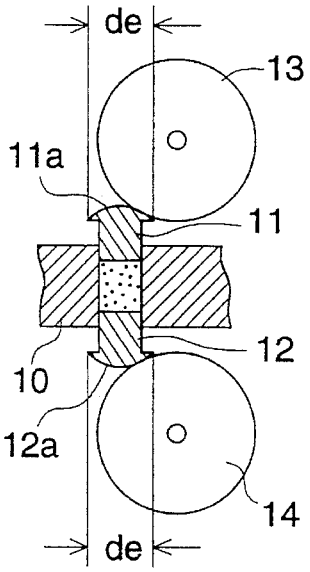
FIGS. 2A through 2C are partially sectional views showing an outline of the rotary tablet machine to explain a process in which a tablet is formed.
Figure 2B:
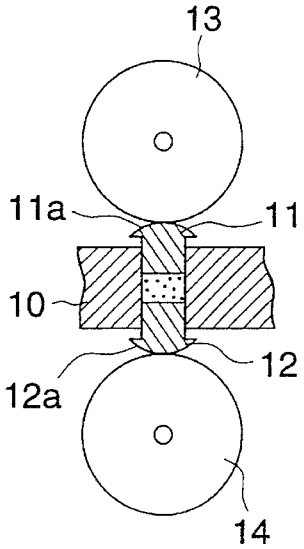
Figure 2C:
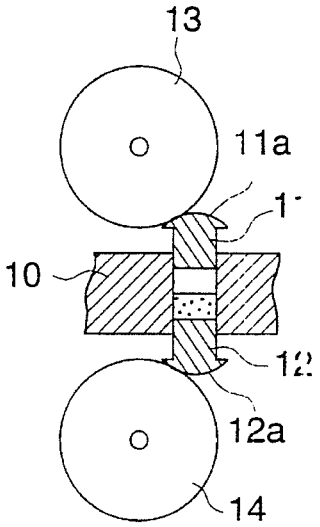

FIG. 2A, FIG. 2B and FIG. 2C show a process in which particles and/or granules are compressed and formed into tablets by the rotary tablet machine. FIG. 2A shows a condition in which the upper pounder 11 and the lower pounder 12 approach each other compress the grains and/or granules by the action of the upper and lower compression rollers 13, 14. FIG. 2B shows a condition in which the lowermost end of the upper compression roller 13 moves horizontally along the upper end of the upper pounder 11 and also the uppermost end of the lower compression roller 14 moves horizontally along the lower end of the lower pounder 12. FIG. C shows a condition in which the compression is completed. Numeral 10 is a turn table. Numeral 11*a* is a bottom surface of the upper pounder 11, and numeral 12*a* is a bottom surface of the lower pounder 12.

In the device shown in FIGS. 2A through 2C, the compression dwell time is defined as a period of time from when the upper pounder comes into contact with the lowermost end of the upper compression roller and the lower pounder comes into contact with the uppermost end of the lower compression roller, to when the upper and lower pounders are separate from the upper and lower compression rollers. Therefore, the compression dwell time is the same as a period of time in which the turn table rotates by a distance equal to the diameter of the bottom surface of the upper or lower pounder.

Therefore, the following equation is established.

$$de = \frac{2\pi RNt}{60}$$

where de (cm) is a diameter of the bottom surface 11*a* or 12*a* of the pounder, R (cm) is a radius of the pitch circle of the mortar center, N (rpm) is a number of revolution of the turn table, and t (sec) is a compression dwell time.

In the invention, the particles preferably have a moisture content of 0.05 to 3.0 wt %. When the moisture content is over 3.0 wt %, lubricity is lowered, and in compression molded tablets are likely to adhere to the mortar and to be pulled in a direction opposite the compression direction, resulting in strain inside the tablets. The strain tends to cause capping immediately after tableting and to produce defects or breakage due to impact during storage, resulting in lowering of the effects of the invention. As is apparent from the above mentioned, moisture is necessary for tableting.

It is preferable in view of the effects of the invention that the content of particles having diameters of 53 μm or less in the particles of the invention is not more than 10 wt %. This is preferable for tablets with poor binding ability in preventing capping or lamination.

The particles preferably have a bulk density of 0.4 to 0.95 g/cm$^3$ in that the invention is more markedly effected. Since the granules having a bulk density over 0.95 g/cm$^3$ are difficult to be broken in compression-molding (tableting), the bulk density is preferably not more than 0.95 g/cm$^3$ in view of the effects of the invention. When the bulk density is less than 0.4 g/cm$^3$, too bulky particles and/or granules are likely to fluctuate in loading amount in molding. The bulk density of not less than 0.4 g/cm$^3$ can eliminate the fluctuation of the loading amount.

The granules preferably have a strength of 100 to 4000 g/mm$^2$ in that the invention is more markedly effected. Granules having a strength over 4000 g/mm$^2$ are difficult to be broken in compression-molding (tableting), and the strength is preferably not more than 4000 g/mm$^2$ in view of the effects of the invention. When the strength is less than 100 g/mm$^2$, tablets are likely to produce defects or breakage, resulting in an increase of compression-molding failure. Therefore, the strength is preferably not less than 100 g/mm$^2$ in view of the effects of the invention. The strength of granules is represented by the following expression; Strength of granules=0.7 P/A (g/mm$^2$)

wherein $A=\pi d^2\times 1/4$, A represents a sectional area (mm$^2$) of granules, P represents a loading weight (g) at which the granules are broken, and d represents diameter of the granules (mm). The reference of the strength is made to Yoshio Hiramatsu and Yukitoshi Seki, Nikkoshi, 81,1024(1965).

In the invention the above P and d were measured by GRANO, a particle hardness tester produced by Okada Seimitsu Kogyo Co., Ltd. The measurement were carried out at 25° C. and at 45% RH P is an arithmetical average value of 20 pieces of granules.

The particles preferably have a weight average particle diameter of 100 to 600 μm in that the invention is more markedly effected. Granules having a strength over 4000 g/mm$^2$ are difficult to be broken in compression-molding (tableting), and the strength is preferably not more than 4000 g/mm$^2$ in view of the effects of the invention. When the weight average particle diameter is within the above range, physical properties are stable in continuous tableting and the tablets of the invention can be manufactured stably.

In the manufacturing method of the invention the photographic agent for compression-molding into tablets is preferably in the form of granules, since the granule form is high in the effects of the invention. The granules are broken in compression-molding to produce fresh surfaces having not been exposed to air and contribute to an increase of the binding ability.

As for the granulating processes for forming the granules, it is possible to use any of the well-known processes such as the processes of a rolling granulation, an extrusion granulation, a compression granulation, a cracking granulation, a stirring granulation and a fluidized-layer granulation. The granules are preferably produced to have a strength of 100 to 4000 g/mm$^2$ in view of the effects of the invention.

The tablets of the invention include a color developing composition, a black-and-white developing composition, a bleaching composition, a fixing composition, a bleach-fixing composition and a stabilizing composition.

Color developing agents include p-phenylene diamine type compounds disclosed in paragraphs 0083 to 0086 of Japanese Patent O.P.I. Publication No. 5-232656 in view of the effects of the invention. Of these compounds the following exemplified compounds are especially preferable.

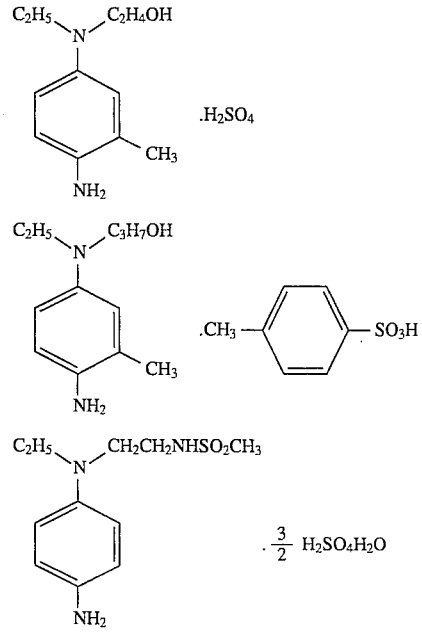

Hydroxylamines or derivatives thereof include compounds disclosed in paragraphs 0100 to 0130 of Japanese Patent O.P.I. Publication No. 5-232656 in view of the effects of the invention. Of these compounds bis(sulfoethyl)hydroxylamine disodium salt or hydroxylamine is especially preferable.

Alkali metal carbonates include compounds disclosed in paragraph 0105 of Japanese Patent O.P.I. Publication No. 5-232656 in view of the effects of the invention. Of these compounds potassium carbonate is especially preferable.

Amino polycarboxylic acid ferric complexes include compounds disclosed in paragraphs 0040 to 0110 of Japanese Patent Application No. 5-106278 in view of the effects of the invention. Of these compounds a ferric complex of ethylenediamine tetraacetic acid, 1,3-propylenediamine tetraacetic acid or diethylenetriamine pentaacetic acid is especially preferable.

EXAMPLES

The invention will be detailed in the following Examples.

Example 1

A color developing replenishing agent for a color paper was prepared according to the following procedures.

Procedure (A)

In a bandamu-mill available on the market 1450 g of a color developing agent CD-3 (4-amino-3-methyl-N-ethyl-N-β-methanesulfonamidoethyl-aniline sulfate) was pulverized to have an average particle size of 30 μm. The resulting fine particles were granulated in a stirring granulator available on the market by adding 50 ml of water. Thereafter, the granules were dried at 40° C. for 2 hours in a fluid-bed type drier available on the market to have a moisture content of 0.05 wt %. Thus, color developing granules A for a color paper was prepared. The granules A had a weight average diameter of 250 μm, a bulk density of 0.60 g/cm$^3$ and a strength of 500 g/mm$^2$.

Procedure (B)

In the same manner as in Procedure (A) 800 g of bis(sulfoethyl)hydroxylamine disodium salt, 1700 g of sodium p-toluenesulfonate and 30 g of Tinopar as a whitening agent (produced by Ciba-Geigy Co.) were pulverized and mixed with 24 g of Pineflow (produced by Matsutani Kagaku Co., Ltd.), and the mixture was granulated by adding 240 ml of water thereto. Thereafter, the granules were dried at 60° C. for 2 hours to have a moisture content of 1.0 wt %. Thus, color developing granules B for a color paper was prepared. The granules B had a weight average diameter of 240 μm, a bulk density of 0.70 g/cm$^3$ and a strength of 800 g/mm$^2$.

Procedure (C)

In the same manner as in Procedure (A) 330 g of pentasodium diethylenetriamine pentaacetate, 130 g of sodium p-toluenesulfonate, 35 g of sodium sulfite, 350 g of lithium hydroxide monohydrate and 3300 g of anhydrous potassium carbonate were pulverized and mixed with 600 g of mannitol (produced by Kao Co., Ltd.) and 1500 g of PEG#4000 (Mw=4000, produced by Nihon Yushi Co., Ltd.). Then, the mixture was granulated by adding 260 ml of water thereto. Thereafter, the granules were dried at 55° C. for 2 hours to have a moisture content of 0.9 wt %. Thus, color developing granules C for a color paper was prepared. The granules C had a weight average diameter of 140 μm, a bulk density of 0.71 g/cm$^3$ and a strength of 3800 g/mm$^2$.

The above obtained granules in Procedures (A), (B) and (C) were mixed for 10 minutes through a cross rotary mixer available on the market at 25° C. and at 45% RH, and mixed with 50 g of sodium n-miristoyl alanine for 3 minutes. One weight % of the resulting mixture granules was granules having a particle diameter of 53 μm or less.

Thereafter, the resulting mixture granules were tableted making use of a rotary tableting machine (Clean Press Correct H18 manufactured by Kikusui Mfg. Works) equipped with mortar and pestle at compression pressure and compression dwell time as shown in Table 1 to obtain tablets having a diameter of 30 mm, a thickness of 10.0 mm and a weight of 10.8 g. The diameter and thickness of the resulting tablets were measured and the tablets were subjected to vibration test and dropping test according to the following method. Twenty of the measured tablets were placed in a package vapor-deposited with aluminum, tightly sealed and stored at 50° C. for 4 weeks. Thereafter, the stored package was unpacked, and the diameter and thickness of the tablets were measured and the change was determined. The results are shown in Table 1.

In the following Tables, ΔD (or ΔT)

=Diameter (or Thickness) after storage—Diameter (or Thickness) before storage

Dropping Test: One thousand tablets were dropped from a 100 cm height one by one, and the tablets were evaluated for defects or cracks according to the following criteria.

Evaluation Criteria

A : Neither defects nor breakage were found.

B : One tablet per 1000 tablets had defects or breakage of not more than 0.10 wt % based the total weight of the tablet.

C : Ten tablets per 1000 tablets had defects or breakage of not more than 0.50 wt % based the total weight of the tablet.

D : Fifty tablets per 1000 tablets had defects or breakage.

DD: One hundred tablets per 1000 tablets had defects or breakage.

Vibration Test : The packages containing tablet samples in a package vapor-deposited with aluminum were subjected to a vibration test using a vibration tester BF-UA produced by IDEX Co., Ltd. Thereafter, the packages were unpacked, and the occurrence or adherence to the package of fine powder was observed and evaluated according to the following criteria.

Evaluation Criteria

A : No adherence to the package walls of the powder and no difference from samples before vibration test B : Slight adherence to the package walls of the powder but no problem in practical use C : A definite adherence to the package walls of the powder and fine powder occurrence D : Considerable adherence to the package walls of the powder and considerable fine powder float in unpacking DD-DDD : The more the number of D is, the more the powder occurs in unpacking

TABLE 1

| Experiment No. | Compression pressure (kg/cm$^2$) | Compression dwell time (sec) | ΔD (mm) | ΔT (mm) | Vibration test immediately after tableting | Dropping test imediately after tableting | Remarks |
|---|---|---|---|---|---|---|---|
| 1-1 | 300 | 0.090 | 1.2 | 1.6 | D | D | Comp. |
| 1-2 | 380 | 0.090 | 1.1 | 1.5 | D | D | Comp. |
| 1-3 | 400 | 0.013 | 1.1 | 1.5 | D | D | Comp. |
| 1-4 | 400 | 0.015 | 0.5 | 0.6 | C | C | Inv. |
| 1-5 | 400 | 0.020 | 0.3 | 0.4 | B | B | Inv. |
| 1-6 | 400 | 0.090 | 0.3 | 0.4 | B | B | Inv. |
| 1-7 | 400 | 0.300 | 0.3 | 0.4 | B | B | Inv. |
| 1-8 | 400 | 0.500 | 0.3 | 0.4 | B | B | Inv. |
| 1-9 | 400 | 1.000 | 0.3 | 0.4 | B | B | Inv. |
| 1-10 | 400 | 1.100 | 0.8 | 1.1 | DD | DDD | Comp. |
| 1-11 | 750 | 0.090 | 0.3 | 0.4 | B | B | Inv. |
| 1-12 | 800 | 0.090 | 0.1 | 0.2 | A | A | Inv. |
| 1-13 | 1500 | 0.090 | 0.1 | 0.2 | A | A | Inv. |
| 1-14 | 1600 | 0.090 | 0.1 | 0.2 | B | B | Inv. |
| 1-15 | 3000 | 0.090 | 0.3 | 0.3 | B | B | Inv. |
| 1-16 | 4500 | 0.090 | 0.3 | 0.3 | B | B | Inv. |

TABLE 1-continued

| Experiment No. | Compression pressure (kg/cm$^2$) | Compression dwell time (sec) | ΔD (mm) | ΔT (mm) | Vibration test immediately after tableting | Dropping test imediately after tableting | Remarks |
|---|---|---|---|---|---|---|---|
| 1-17 | 4700 | 0.090 | 0.7 | 0.9 | D | DD | Comp. |
| 1-18 | 5000 | 0.090 | 0.8 | 1.2 | DD | DDD | Comp. |

Comp.: Comparative
Inv.: Invention

As is seen from Table 1, 400 to 4500 kg/cm$^2$ of compression pressure and 0.015 to 1.000 second of compression dwell time give effective prevention of expansion of tablets during storage and an excellent transport properties. Further, from the results of vibration and dropping tests immediately after tableting, tablets reduced in the expansion are excellent also in their strength and anti-abrasion property. The compression dwell time is preferably 0.020 seconds or more.

Example 2

The procedures were carried out in the same manner as in experiment No. 1–12 of Example 1, except that granules were prepared to have a moisture content as shown in Table 2 by lowering the drying temperatures of procedures (A), (B) and (C) and adjusting the drying times. The resulting tablets were evaluated in the same manner as in Example 1. The results are shown in Table 2. The moisture content was measured with an electronic moisture tester available on the market. The tablets are dried to a constant weight at 105° C. and thereafter, the weight reduction was obtained.

TABLE 2

| Experiment No. | Moisture content | ΔD (mm) | ΔT (mm) | Vibration test result | Dropping test result |
|---|---|---|---|---|---|
| 2-1 | 0.01 | 0.3 | 0.4 | B | B |
| 2-2 | 0.04 | 0.3 | 0.4 | B | B |
| 2-3 | 0.05 | 0.1 | 0.2 | A | A |
| 2-4 | 0.10 | 0.1 | 0.2 | A | A |
| 2-5 | 0.50 | 0.1 | 0.2 | A | A |
| 2-6 | 1.00 | 0.1 | 0.2 | A | A |
| 2-7 | 2.00 | 0.1 | 0.2 | A | A |
| 2-8 | 3.00 | 0.1 | 0.2 | A | A |
| 2-9 | 3.20 | 0.3 | 0.4 | B | B |

As is seen from Table 2, the moisture content of 0.05 to 3.0 wt % is highly effected in the invention. In experiment No. 2–9 capping occurred at a rate of one per 1000 tablets in continuous tableting. However, the others produced no capping.

Example 3

The procedures were carried out in the same manner as in experiment No. 1–12 of Example 1, except that the added water amount and mixing time were adjusted in granulating in procedures (A), (B) and (C) and the resulting granules were prepared to have a content of granules having a particle diameter of 53 μm or less as shown in Table 2. Thus, tablets were obtained. The resulting tablets were evaluated in the same manner as in Example 1. The results are shown in Table 3.

TABLE 3

| Experiment No. | Weight % of granules having a particle diameter of 53 μm or less | ΔD (mm) | ΔT (mm) | Vibration test result | Dropping test result |
|---|---|---|---|---|---|
| 3-1 | 0 | 0.1 | 0.2 | A | A |
| 3-2 | 1 | 0.1 | 0.2 | A | A |
| 3-3 | 9 | 0.1 | 0.2 | A | A |
| 3-4 | 10 | 0.1 | 0.2 | A | A |
| 3-5 | 12 | 0.3 | 0.4 | A–B | A–B |
| 3-6 | 20 | 0.3 | 0.4 | B | B |

As is seen from Table 3, when the content of granules having a particle diameter of 53 μm or less is not less than 10 wt %, the invention is highly effected. Experiment No. 3–5 produced capping at a rate of one per 1000 tablets and No. 3–6 at a rate of two per 1000 tablets in continuous tableting. However, samples wherein the content of granules having a particle diameter of 53 μm or less is not less than 10 wt % produced no capping.

Example 4

Tablet samples for fixer replenisher of a color negative film were prepared according to the following Procedure.

Procedure (D)

In the same manner as in Procedure (A) 2500 g of ammonium thiosulfate, 180 g of sodium sulfite, 2 g of disodium ethylenediamine and 20 g of potassium carbonate were pulverized and the mixture was granulated in a granulator available on the market (stirring or fluid-bed type granulator) by adding 70 ml of water to have the bulk density shown in Table 4. The resulting granules were compression-molded into tablets in the same manner as in Experiment No. 1–12 of Example 1 and evaluated in the same manner as in Example 1. The results are shown in Table 4.

TABLE 4

| Experiment No. | Bulk density (g/cm$^3$) | ΔD (mm) | ΔT (mm) | Vibration test result | Dropping test result |
|---|---|---|---|---|---|
| 4-1 | 0.35 | 0.4 | 0.5 | B | B |
| 4-2 | 0.40 | 0.1 | 0.2 | A | A |
| 4-3 | 0.60 | 0.1 | 0.2 | A | A |
| 4-4 | 0.80 | 0.1 | 0.2 | A | A |
| 4-5 | 0.95 | 0.1 | 0.2 | A | A |
| 4-6 | 0.99 | 0.3 | 0.4 | B | B |

As is seen from Table 4, the tablet processing agent having a bulk density of 0.40 to 0.95 g/cm$^3$ is preferable in the invention. In continuous compression-pressure the fluctuation of a loading amount per tablet of Experiment No. 4-1 was two times greater than Experiment Nos. 4-2 through 4-6. This shows that tablets of Experiment Nos. 4-2 through 4-6 are more preferable than those of Experiment No. 4-1 since the fluctuation of the processing solution is reduced to a half.

Example 5

Granules were prepared to have a strength as shown in Table 5 in the same manner as in Example 4, except that the mixing time was adjusted in stirring granulator, and the added velocity of water and granulating temperature were adjusted in fluid-bed type granulator. The experiment were carried out using the resulting granules in the same manner as in Example 1. The results are shown in Table 5.

TABLE 5

| Experiment No. | Strength of granules ($g/cm^3$) | ΔD (mm) | ΔT (mm) | Vibration test result | Dropping test result |
|---|---|---|---|---|---|
| 5-1 | 50 | 0.3 | 0.3 | B | B |
| 5-2 | 90 | 0.3 | 0.3 | B | B |
| 5-3 | 100 | 0.1 | 0.2 | A | A |
| 5-4 | 500 | 0.1 | 0.2 | A | A |
| 5-5 | 1000 | 0.1 | 0.2 | A | A |
| 5-6 | 2000 | 0.1 | 0.2 | A | A |
| 5-7 | 3000 | 0.1 | 0.2 | A–B | A–B |
| 5-8 | 4000 | 0.1 | 0.2 | A–B | A–B |
| 5-9 | 4200 | 0.3 | 0.4 | B | B |
| 5-10 | 4500 | 0.4 | 0.4 | B | B |

As is seen from Table 5, granules having a strength of 100 to 4000 $g/mm^2$ are preferable in the invention. The strength is more preferably 100 to 2000 $g/mm^2$.

Example 6

Procedure (E)

In the same manner as in Procedure (A) 180 g of sodium sulfite, 2 g of disodium ethylenediamine, 20 g of potassium carbonate and 70 g of Oil Q (produced by Nichiden Kagaku Co., Ltd.) were granulated by adding water and dried to obtain granules E-1. Twenty five thousand grams of ammonium thiosulfate (crystal forms, produced by Hoechst Co., Ltd.) were screened to obtain particles E-2 having a weight average diameter of 500 μm. E-1 and E-2 were processed in the same manner as in Example 1. The results were the same as Example 1. It has been proved that the particles show the same results as the granules.

What is claimed is:

1. A method of manufacturing a tablet processing agent for a silver halide photographic light-sensitive material, said method comprising the steps of:

putting particles comprising said processing agent into a mold, and compressing said particles at a compression pressure in the range of 400 to 4500 $kg/cm^2$ and at a compression dwell time in the range of 0.015 to 1.000 second, wherein said processing agent is a compound selected from the group consisting of a p-phenylene diamine and its derivatives, a hydroxylamine and its derivatives, an alkali metal carbonate, ferric complex of an amino polycarboxylic acid, and a thiosulfate.

2. The method of claim 1, wherein said compression dwell time is in the range of 0.020 to 1.000 second.

3. The method of claim 1, wherein said particles are granules having a particle diameter in the range of 53 to 2830 μm.

4. The method of claim 1, wherein the particles have a moisture content in the range of 0.05 to 3.0 wt %.

5. The method of claim 1, wherein the particles have a weight average diameter in the range of 100 to 600 μm.

6. The method of claim 1, wherein not more than 10 wt % of the particles have a diameter of 53 μm or less.

7. The method of claim 1, wherein the particles have a bulk density in the range of 0.4 to 0.95 $g/cm^3$.

8. The method of claim 3, wherein the strength of the granules is 100 to 400 $g/^2$, the strength being represented by the following equation:

$$\text{Strength of granules} = 0.7\ P/A\ (g/mm^2)$$

wherein $A=\pi d^2 \times 1/4$, A represents a cross-sectional area ($mm^2$) of the granules, P represents a loading weight (g) at which the granules are broken, and d represents a diameter of the granules (mm).

* * * * *